US006755411B2

(12) United States Patent
Janatka et al.

(10) Patent No.: US 6,755,411 B2
(45) Date of Patent: Jun. 29, 2004

(54) ENVELOPE TRANSPORT MODULE WITH VACUUM PORTS FOR USE IN AN ENVELOPE INSERTING MACHINE

(75) Inventors: Karel J. Janatka, Southbury, CT (US); Boris Rozenfeld, New Milford, CT (US); John W. Sussmeier, Cold Spring, CT (US); Joseph R Vassallo, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 63 days.

(21) Appl. No.: 10/280,170

(22) Filed: Oct. 25, 2002

(65) Prior Publication Data

US 2004/0080099 A1 Apr. 29, 2004

(51) Int. Cl.[7] ..... B65H 5/00
(52) U.S. Cl. ..... 271/2; 271/246; 270/58.06
(58) Field of Search ..... 271/2, 245, 246, 271/276, 197, 243, 253; 270/58.06

(56) References Cited

U.S. PATENT DOCUMENTS 3,823,937 A * 7/1974 Hirafuji ..... 271/276
4,169,341 A * 10/1979 Roetter et al. ..... 53/154
5,131,643 A * 7/1992 Graveson et al. ..... 271/2
5,147,092 A * 9/1992 Driscoll et al. ..... 271/184
5,255,906 A * 10/1993 Ballard et al. ..... 271/246
5,288,067 A * 2/1994 Stock ..... 271/276
5,374,044 A * 12/1994 Belec et al. ..... 271/2
5,465,662 A * 11/1995 Keung et al. ..... 101/235
5,660,030 A * 8/1997 Auerbach et al. ..... 53/569

* cited by examiner

*Primary Examiner*—David H. Bollinger
(74) *Attorney, Agent, or Firm*—Michael J. Cummings; Charles R. Malandra, Jr.; Angelo N. Chaclas

(57) ABSTRACT

A module in an envelope insertion station for transporting an envelope to an enclosure material insertion location, which uses endless belts to move the envelope until it is stopped by rotatable stops. A fixedly-mounted vacuum module having vacuum ports provides a suction force to the envelope urging the trailing edge of the envelope to press against the belts and provides the normal force required to move an envelope downstream as it enters the insertion deck without slippage against the translating endless belts. Additionally, a second vacuum module having vacuum ports provides suction force urging the leading edge of the envelope to press against the belts and provides the normal force required to prohibit the leading edge of the envelope from buckling during impact with the rotatable stops. The second vacuum module is removably mounted and mechanically linked to the rotatable stops so they can be repositioned together to accommodate different-sized envelopes.

7 Claims, 10 Drawing Sheets

ENVELOPE TRANSPORT MODULE WITH VACUUM PORTS FOR USE IN AN ENVELOPE INSERTING MACHINE

TECHNICAL FIELD

The present invention relates generally to a mail inserting system and, more particularly, to an envelope transport module to be used in the envelope insertion station in the mail inserting system.

BACKGROUND OF THE INVENTION

In a typical mail inserting system, a plurality of enclosure feeders are used to release enclosure documents onto a chassis or deck. The released documents are collated into stacks and pushed from an upstream direction to a downstream direction into an envelope inserting station where each stack of the collated documents is inserted into an envelope. Mail inserting systems are known in the art. For example, Roetter et al. (U.S. Pat. No. 4,169,341) discloses a mail inserting system consisting of a document collating section and an envelope insertion section, wherein a plurality of document feeders are used to release documents onto a continuous conveying mechanism that collects and collates the documents and then conveys the collated documents to the envelope insertion section in a continuous manner. Auerbach et al. (U.S. Pat. No. 5,660,030) discloses a high speed envelope inserting station wherein a plurality of depressor fingers are used for applying pressure to the envelope flap during the insertion of the enclosure material. At the same time, a pair of throat openers are used to keep the throat of the envelope opened by separating the bottom side of the envelope from the upper side. Belec et al. (U.S. Pat. No. 5,374,044) discloses an envelope inserting device wherein a plurality of rotatable stops are used to register the envelope at the insertion location. The rotatable stops can be rotated away to allow a stuffed envelope to move downstream. Before the envelope is stuffed, it is moved into the insertion location by a plurality of endless belts. After being stuffed, the envelope is moved away from the insertion station by the same belts. Furthermore, a rotatable vacuum drum and a fixed vacuum deck are used to provide a vacuum suction force to the envelope for urging the envelope to press against the endless belts.

In general, a mail inserting system 1, as shown in FIG. 1, comprises an envelope supply module 10, an envelope insertion station 20 and an enclosure material supply module 30. In the envelope supply module 10, an envelope feeder (not shown) is used to retrieve one envelope 12 at a time from a stack 13 and release the retrieved envelope to the envelope insertion station. The envelope 12, after being fed from below a transport module 50 through an exit path 22, is moved to an insertion location defined by a plurality of rotatable stops 82. The flap of the envelope 12 stays opened as the enclosure material 32 is moved from the enclosure supply module 30 into the envelope insertion station 20 to be inserted into the envelope 12. After the insertion, the rotatable stops 82 are rotated away so that the stuffed envelope 42 can be moved out of the envelope insertion station 20.

In Belec et al., the vacuum ports on the vacuum deck are distributed over a large area so that the vacuum suction force can be applied to a large envelope as well as a small envelope. On the one hand, when a small envelope is positioned at the insertion location, a considerable part of the vacuum suction force is wasted because the envelope only covers a small number of vacuum ports. On the other hand, when a large envelope is used, it covers a large number of vacuum ports. Consequently, the suction force exerting on the large envelope may be too large, rendering the moving of the envelope from the upstream end to the insertion location difficult.

FIGS. 2 to 5 are schematic representations of a prior art transport module 50, wherein a plurality of endless belts 58, driven by rollers 54, 56, are used to move an envelope from the upstream end to the downstream end along a direction 250. There is a gap 60 between a plurality of adjacent endless belts 58, running along the belts from the upstream end to the downstream end. A registration mechanism 80 having a plurality of rotatable stops 82 is used to stop the envelope at an insertion location 240 so that enclosure material can be inserted into the envelope. Each of the rotatable stops 82 protrudes above the surface of the endless belts 58 through the gap 60 into the moving path of the incoming envelope. As shown in FIG. 3, when the rotatable stops 82 are oriented at an upright position, the edge 84 of each rotatable stop 82 provides a registration point to the envelope to be inserted with enclosure material. After the envelope is inserted with enclosure material, the rotatable stops will be rotated in a clockwise direction by 90 degrees so as to allow the stuffed envelope to move out of the insertion location along the moving direction 250. As shown in FIG. 4, the envelope 12 has a leading edge 14, a trailing edge 16 and a flap 18 at the trailing edge. The leading edge 14 of the envelope 12 is stopped by the rotatable stops 82. In order to hold down the envelope 12 for insertion, a vacuum module 70 is used to provide a suction force on the envelope 12. As shown in FIGS. 2 and 3, the vacuum module 70 comprises a plurality of vacuum ports 72 along the gaps 60. The vacuum module 70 has two air outlets 74 from which the air in the vacuum module 70 is drawn in order to create a negative pressure in the vacuum module 70. When the vacuum ports 72 are covered by the envelope 12, the covered vacuum ports 72 provide a vacuum suction force 272 through the gaps 60 for urging the envelope 12 to press against the endless belts 58. In addition to holding down the envelope 12 during the envelope insertion process, the suction force 272 provided by the vacuum ports 72 is also necessary for the movement of the envelope 12 to the insertion location 240. It should be noted that that after an envelope is released by the envelope supply module 10 through the exit path 22 (FIG. 1), the transport module 50 must pick up the envelope 12 and move it toward the downstream end. As the suction force 272 exerted through the vacuum ports 72 causes the envelope 12 to press against the surface of the endless belts 58, frictional force between the envelope 12 and the surface of the endless belts 58 is developed, and this frictional force renders it possible for the endless belts 58 to carry the envelope 12 along the moving direction 250 until the leading edge 14 of the envelope 12 registers with the edge 84 of the rotatable stops 82 (see FIG. 3).

The envelope must be positioned at the insertion location in order to receive the enclosure material for insertion. To accommodate envelopes of different sizes, the position of the registration mechanism 80 must be adjustable so that the rotatable stops 82 can be moved toward the upstream end or toward the downstream end according to the size of the envelope. For registration purposes, the size of the envelope 12 is defined by the leading edge 14 and the trailing edge 16 of the envelope. To register a large envelope 12', as shown in FIG. 5, the registration mechanism 80 is moved closer to the downstream end. A large envelope 12' covers a large number of vacuum ports 72. While this coverage reduces the waste of the vacuum suction, it may create excessive frictional force between the envelope 12 and the surface of the endless belts 58 hindering the movement of the envelope 12'. In order to avoid this excessive frictional force problem, one could reduce the negative pressure in the vacuum module 70. However, the reduction of negative pressure may result in insufficient frictional force for a small envelope.

Thus, it is desirable and advantageous to provide a transport module wherein the vacuum suction force is more properly provided to the envelope at the insertion location, while the transport module can accommodate a wide range of envelope sizes.

SUMMARY OF THE INVENTION

It is a primary objective of the present invention to provide a transport module which is capable of providing a substantially equal vacuum suction force to envelopes of different sizes when the envelope is positioned at the insertion location. This objective can be achieved by disposing at least two vacuum modules in the transport module in order to provide the vacuum suction force to the envelope at the insertion location. One of the vacuum modules can be repositioned according to the size of the envelope.

Thus, according to the first aspect of the present invention, there is provided an envelope transport module to be used in an envelope insertion station of a mail inserting machine, wherein an envelope has a leading edge and a trailing edge defining a dimension of the envelope, the trailing edge having a flap which is opened for enclosure material insertion when the envelope is securely held at an insertion location in the envelope insertion station, wherein the transport module comprises:

a frame having an upstream end and a downstream end;

a transport mechanism disposed on the frame for moving the envelope from the upstream end to the insertion location, the transport mechanism having a support surface to support the envelope;

a registration mechanism to register the leading edge of the envelope as the envelope reaches the insertion location, wherein the registration mechanism is adjustably mounted on the frame so as to allow the registration mechanism to be positioned at a location between the upstream end and the downstream end in order to accommodate the dimension of the envelope; and a vacuum suction device positioned relative to the frame between the upstream end and the downstream end so as to urge the envelope to press against the support surface, wherein the vacuum suction device comprises a first vacuum module and a separate second vacuum module, and wherein the first vacuum module is disposed between the upstream end and the registration mechanism near the upstream end to provide a suction force on the envelope near the trailing edge thereof, and the second vacuum module is adjustably disposed between the first vacuum module and the registration mechanism so that the second vacuum module can be repositioned to provide a further suction force on the envelope near the leading edge thereof.

Preferably, the first vacuum module is fixedly disposed on the frame.

Preferably, the second vacuum module is mechanically linked to the registration mechanism so that the second vacuum module is relocated along with the registration mechanism, based on the dimension of the envelope.

Preferably, the transport mechanism comprises a plurality of conveyor belts moving from the upstream end to the downstream end, wherein a gap is provided between two adjacent conveyor belts, extending from the upstream end to the downstream end, and the second vacuum module has at least one vacuum port located in the gap for providing the further suction force.

Preferably, the registration mechanism comprises a plurality of rotatable stops operable in a first position protruding over the support surface to register the leading edge of the envelope as the envelope is located at the insertion location, and in a second position to retreat under the support surface so as to allow the envelope to move downstream after the insertion is completed.

According to the second aspect of the present invention, there is provided a method of securing an envelope on an envelope transport module in an envelope insertion station of a mail inserting machine, wherein the envelope has a leading edge and a trailing edge defining a dimension of the envelope, the trailing edge having a flap which is opened for enclosure material insertion when the envelope is securely held at an insertion location in the envelope insertion station, wherein the transport module comprises:

a frame having an upstream end and a downstream end;

a transport mechanism disposed on the frame for moving the envelope into the envelope insertion station from the upstream end to the insertion location, the transport mechanism having a support surface to support the envelope;

a registration mechanism to register the leading edge of the envelope as the envelope reaches the insertion location, wherein the registration mechanism is adjustably mounted on the frame so as to allow the registration mechanism to be located to a location between the upstream and downstream ends in order to accommodate the dimension of the envelope; and a vacuum suction device positioned relative to the frame between the upstream end and the downstream end for urging the envelope to press against the support surface. The method comprises the steps of:

providing at least one first vacuum port in the vacuum suction device in order to apply a suction force on the envelope near the trailing edge thereof, and providing at least one second vacuum port in the vacuum suction device between said at least one first vacuum port and the registration mechanism, wherein said at least one second vacuum port can be repositioned in order to apply a further suction force on the envelope near the leading edge thereof.

Preferably, said at least one vacuum port is mechanically linked to the registration mechanism so as to allow said at least one vacuum port to be repositioned along with the registration mechanism based on the dimension of the envelope.

The present invention will become apparent upon reading the description taken in conjunction with FIGS. 6 to 12.

BEST MODE TO CARRY OUT THE INVENTION

Figure 1:
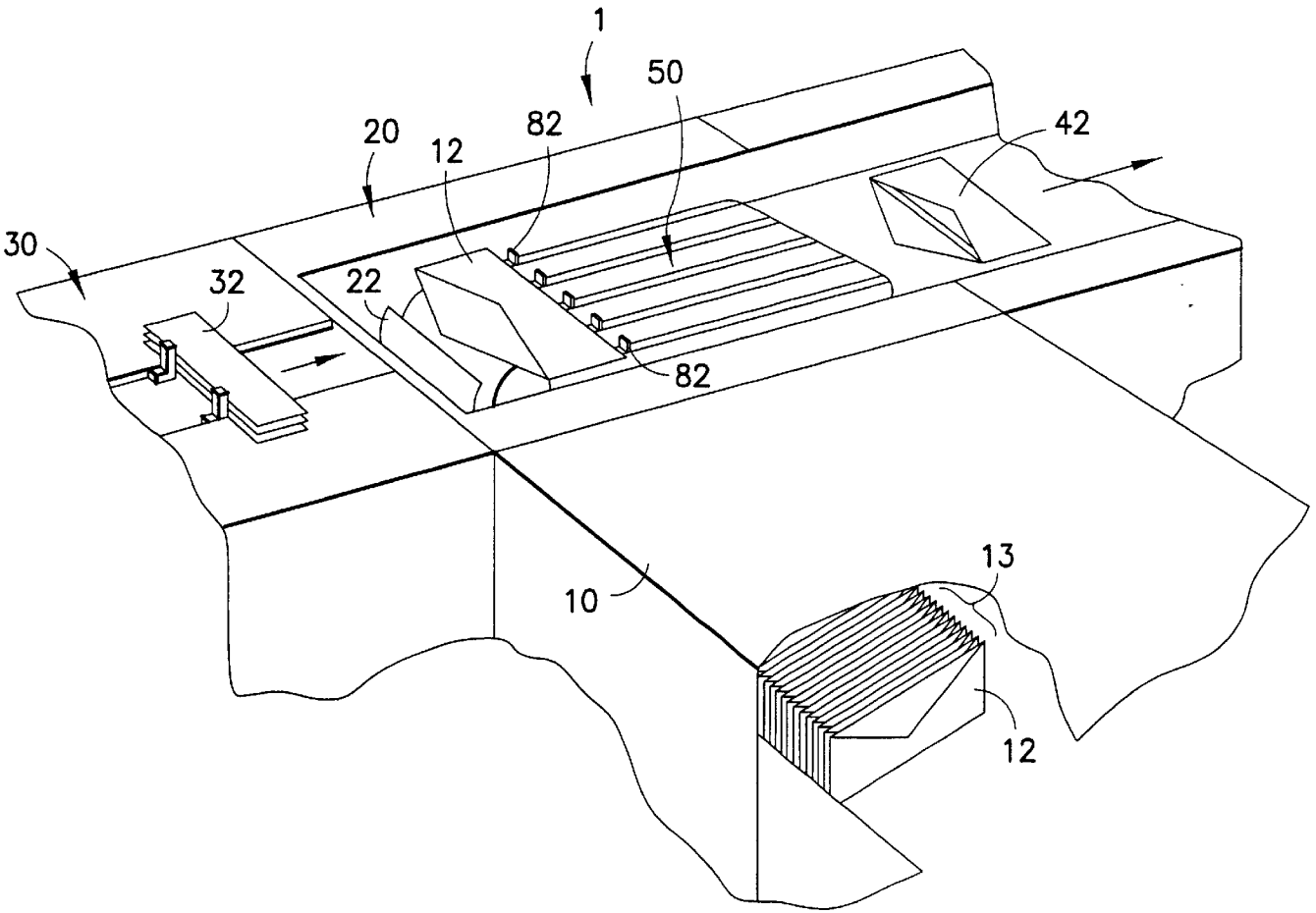
FIG. 1 PRIOR ART
FIG. 1 is a schematic representation showing part of a typical mail inserting system.
Figure 2:
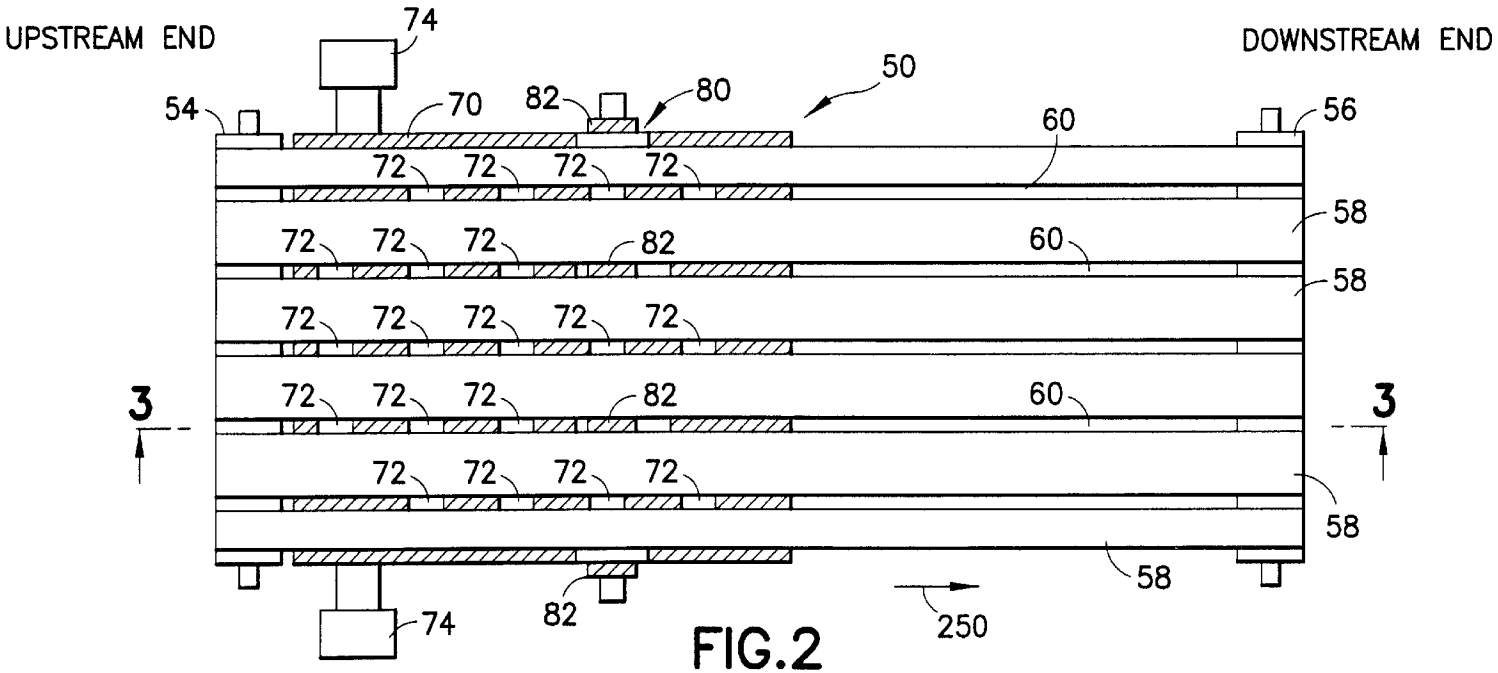
FIG.2 PRIOR ART
FIG. 2 is a schematic representation showing a top view of a prior art transport module.
Figure 3:
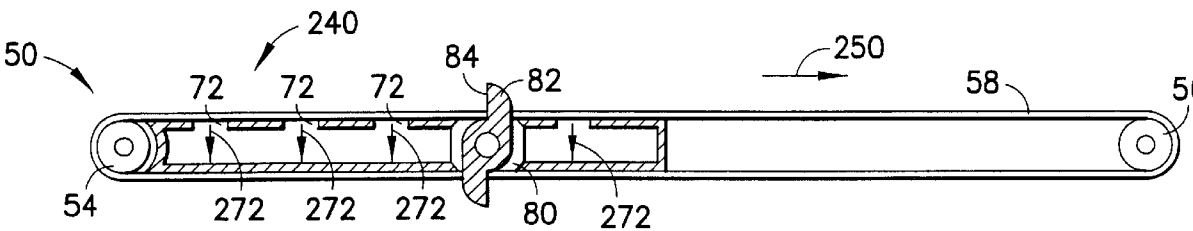
FIG.3 PRIOR ART
FIG. 3 is a schematic representation showing a cross sectional view of the transport module of FIG. 2.
Figure 4:
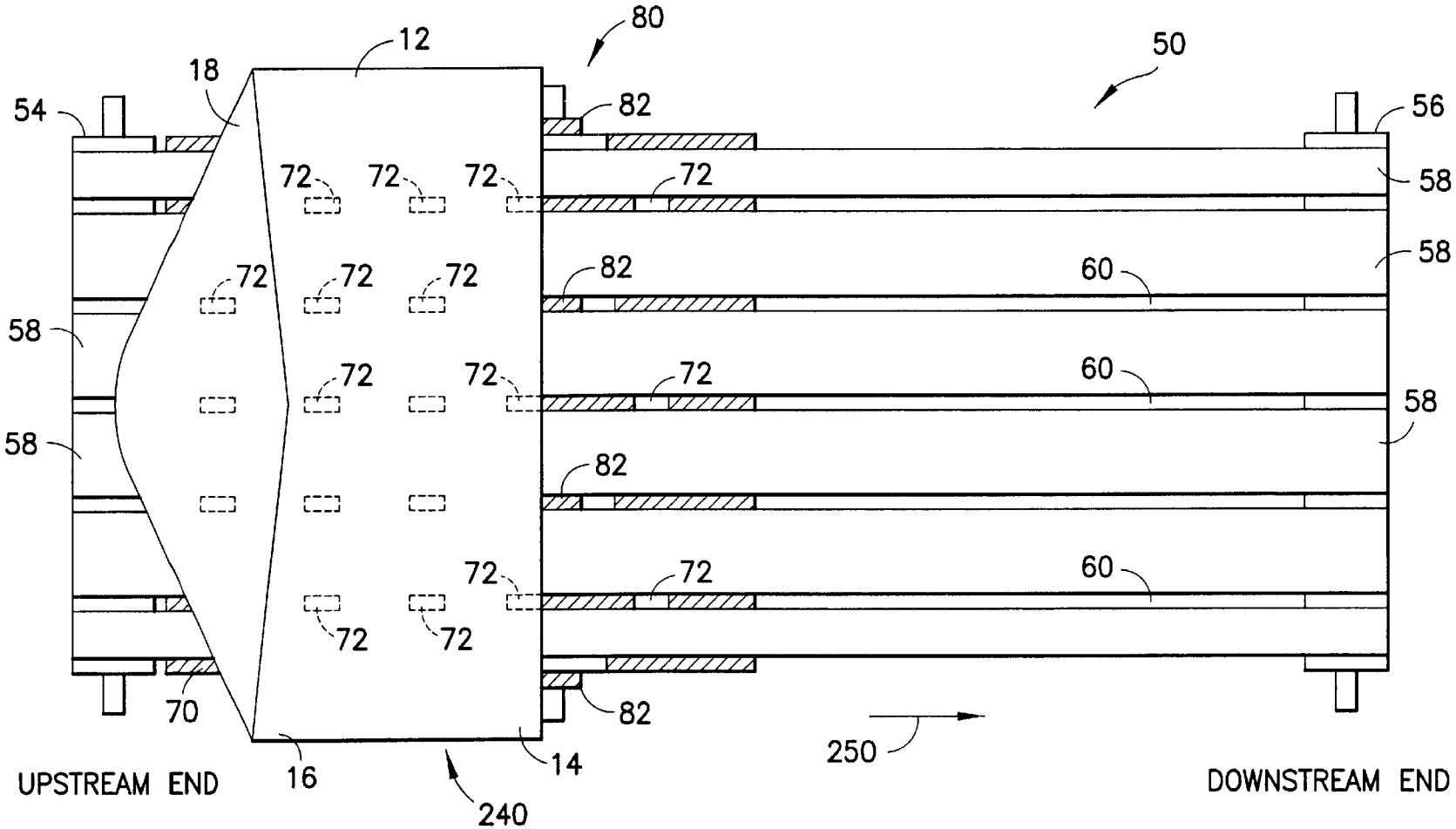
FIG.4 PRIOR ART
FIG. 4 is a schematic representation showing the prior art transport module having an envelope positioned at the insertion location.
Figure 5:
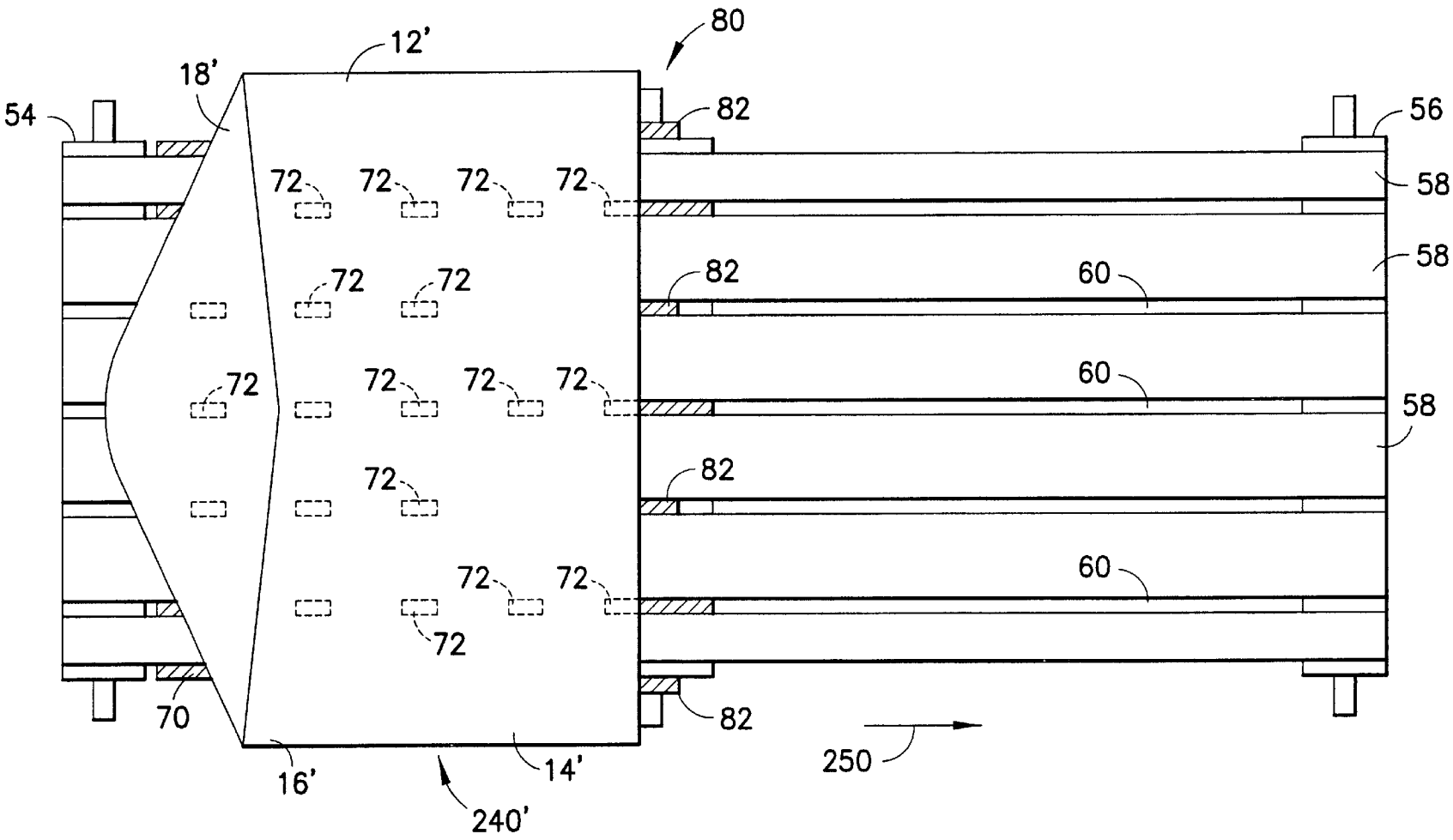
FIG.5 PRIOR ART
FIG. 5 is a schematic representation showing the prior art transport module with a larger envelope positioned at the insertion location.
Figure 6:
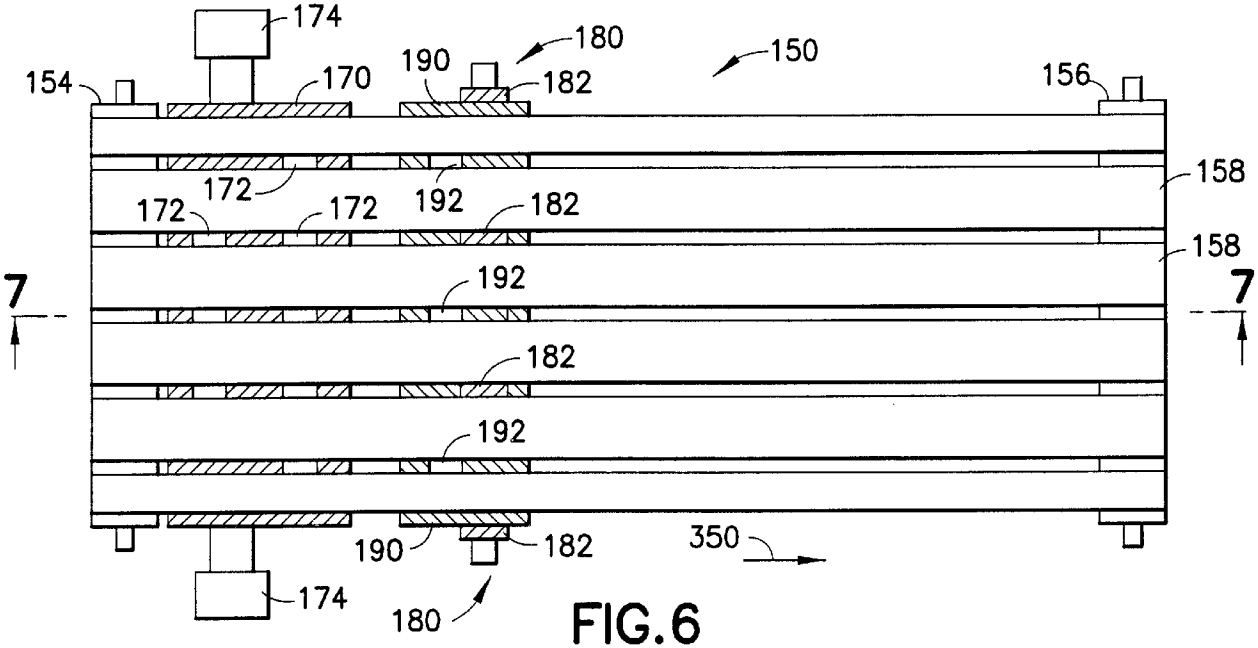
FIG. 6 is a schematic representation showing a top view of the transport module, according to the present invention.
Figure 7:
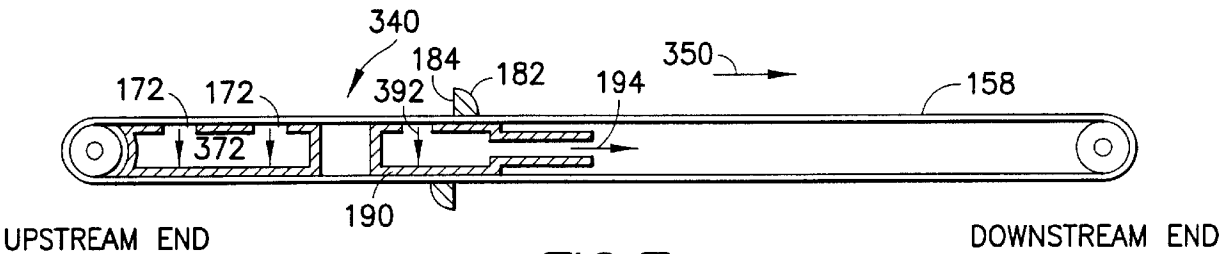
FIG. 7 is a schematic representation showing a cross sectional view of the transport module of FIG. 6.
Figure 8:
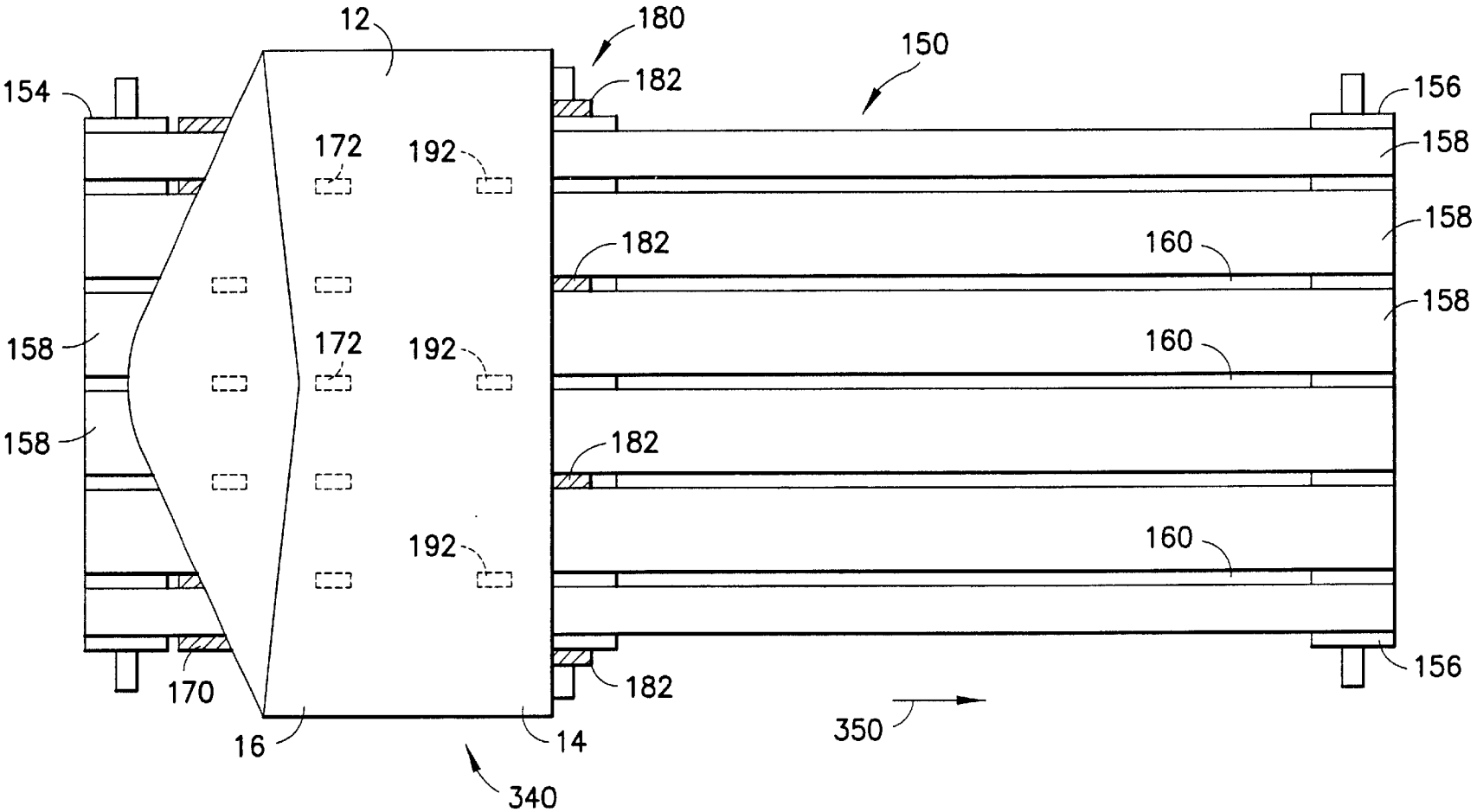
FIG. 8 is a schematic representation showing a transport module of FIG. 6 with an envelope positioned at the insertion location.

FIGS. 6 and 7 are schematic representations of the transport module 150, according to the present invention. As shown, the transport module 150 uses a plurality of endless belts 158, driven by rollers 154, 156, to move an envelope from the upstream end to the downstream end along a direction 350. There is a gap 160 between a plurality of adjacent endless belts 158, running along the belts from the upstream end to the downstream end. A registration mechanism 180 is used to stop the envelope at an insertion location 340 where enclosure material is inserted into the envelope. Each of the rotatable stops 182 protrudes above the surface of the endless belts 158 through the gap 160 into the moving path of the incoming envelope. As shown in FIG. 7, when the rotatable stops 182 are oriented at an upright position, the edge 184 of each rotatable stop 182 provides a registration point to the envelope to be inserted with enclosure material. After the envelope is inserted with enclosure material, the rotatable stops will be rotated in a clockwise direction by 90 degrees so as to allow the stuffed envelope to move out of the insertion location along the moving direction 350. As shown in FIG. 8, the envelope 12 has a leading edge 14, a trailing edge 16 and a flap 18 at the trailing edge. The leading edge 14 of the envelope 12 is stopped by the rotatable stops 182. In order to hold down the envelope 12 for insertion, two vacuum modules 170 and 190 are used to provide a suction force on the envelope 12. As shown in FIGS. 6 and 7, the vacuum module 170 comprises a plurality of vacuum ports 172 along the gaps 160. The vacuum module 170 has two air outlets 174 from which the air in the vacuum module 170 is drawn in order to create a negative pressure in the vacuum module 170. When the vacuum ports 172 are covered by the envelope 12, the vacuum ports 172 provide a vacuum suction force 372 through the gaps 160 for urging the envelope 12 to press against the endless belts 158. Preferably, the vacuum module 170 is fixedly disposed near the upstream end of the transport module 150 to provide the vacuum suction force 372 near the trailing edge 16 of the envelope 12. The vacuum module 190 is disposed between the vacuum module 170 and the registration mechanism 180. The vacuum module 190 has a plurality of vacuum ports 192 and an air outlet 194 from which air in the vacuum module 190 is drawn in order to create a negative pressure in the vacuum module 190. When the vacuum ports 192 are covered by the envelope 12, they provide a further vacuum suction force 392 to the envelope 12.

Figure 9:
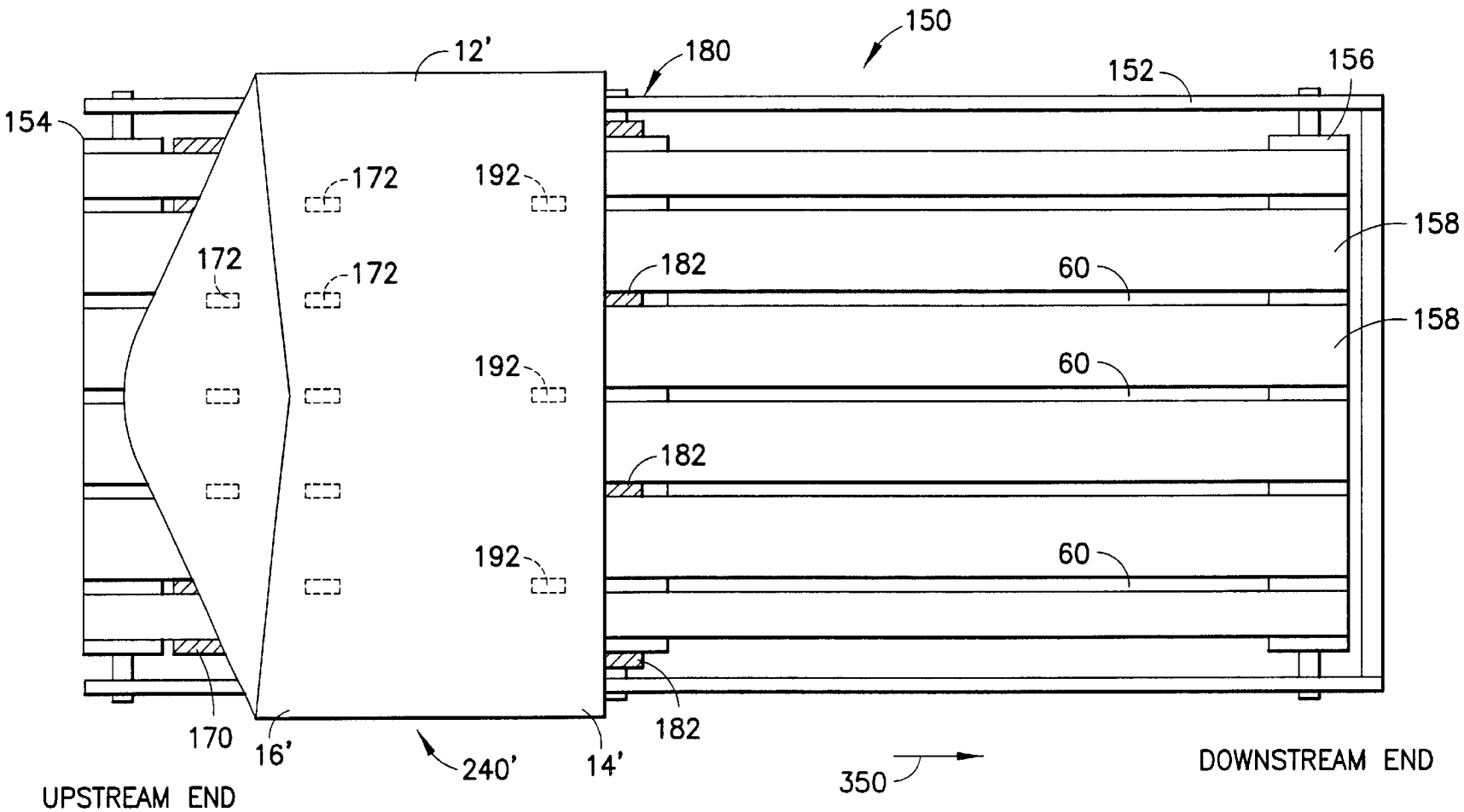
FIG. 9 is a schematic representation showing the transport module of FIG. 6 with a larger envelope positioned at the insertion location.

In order to accommodate envelopes of different sizes, the position of the registration mechanism 180 must be adjustable so that the rotatable stops 182 can be moved toward the upstream end or toward the downstream end according to the size of the envelope. The size of the envelope 12 is defined by its leading edge 14 and its trailing edge 16. To register a larger envelope 12', as shown in FIG. 9, the registration mechanism 180 is moved closer to the downstream end. Preferably, the vacuum module 190 is also adjustable so that it can be moved toward the upstream end or toward the downstream end according to the size of the envelope. Preferably, the vacuum module 190 is mechanically linked to the registration mechanism 180 so that they can be repositioned together to accommodate the size of the envelope. As such, the vacuum suction force 392 is provided on the envelope 12 near the leading edge 14 of the envelope 12. With the adjustable vacuum module 190, the total vacuum suction force 372, 392 provided on a smaller envelope 12, as shown in FIG. 8, and on a larger envelope 12', as shown in FIG. 9, is substantially the same. Thus, the friction force between the envelope and the surface of endless belts resulted from the vacuum suction force is substantially the same, independent of the size of the envelope, within a reasonable size range.

It is understood that the transport module 150, as shown in FIG. 9, has a frame 152 on which the rollers 154, 156 and the vacuum modules 170, 190 are mounted. The rollers 154, 156 are driven by a movement mechanism, such as a motor (not shown). Likewise, the rotatable stops 182 are driven by a rotation mechanism (not shown) so that they can be positioned at the upright position or be rotated away from that position. The position of the registration mechanism 180 and the second vacuum module 190 can be adjusted manually or by a movement mechanism. It should be noted that the placement of the vacuum ports 172, 192, as shown in FIGS. 4 to 9, is for illustration purposes only. The number of vacuum ports 172, 192 partly depends on the strength of the suction force required to properly hold down an envelope, and partly on the frictional force between the envelope and the surface of endless belts as created by the pressing of the envelope against the endless belts. While a weak suction force does not ensure that the envelope can be securely and properly held down at the insertion location for insertion, a strong suction force may cause the envelope to buckle in an upward direction once its lead edge becomes registered against the rotatable stops. It has been found that the fixed mounted vacuum module 170 primarily provides the normal force required to translate an envelope in the downstream direction as it enters the insertion station 20 without slippage against the endless belts 158. It has also been found that the movable vacuum module 190 primarily provides the normal force required to prohibit the leading edge 14 of the envelope 12 from buckling during impact with the rotatable stops 182. Secondarily, both vacuum modules 170 and 190 provide envelope stability during the insertion process and also provide the required normal force to rapidly accelerate the envelope from the insertion station 20 after insertion is complete and the stops rotate below the surface of the endless belts 158.

Figure 10:
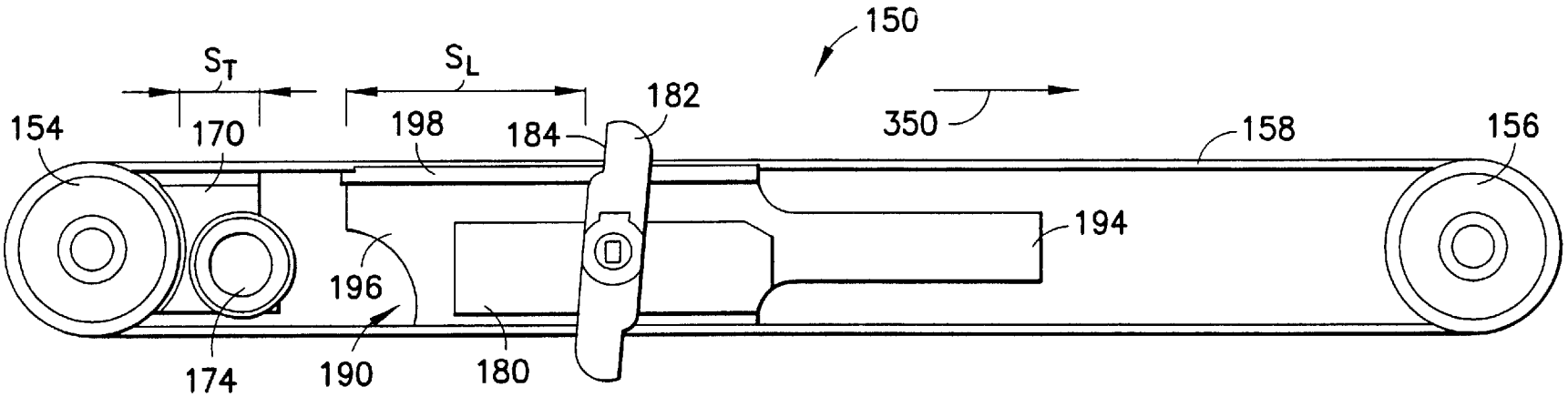
FIG. 10 is an orthogonal view showing the side of the transport module, according to the preferred embodiment of the present invention.
Figure 11:
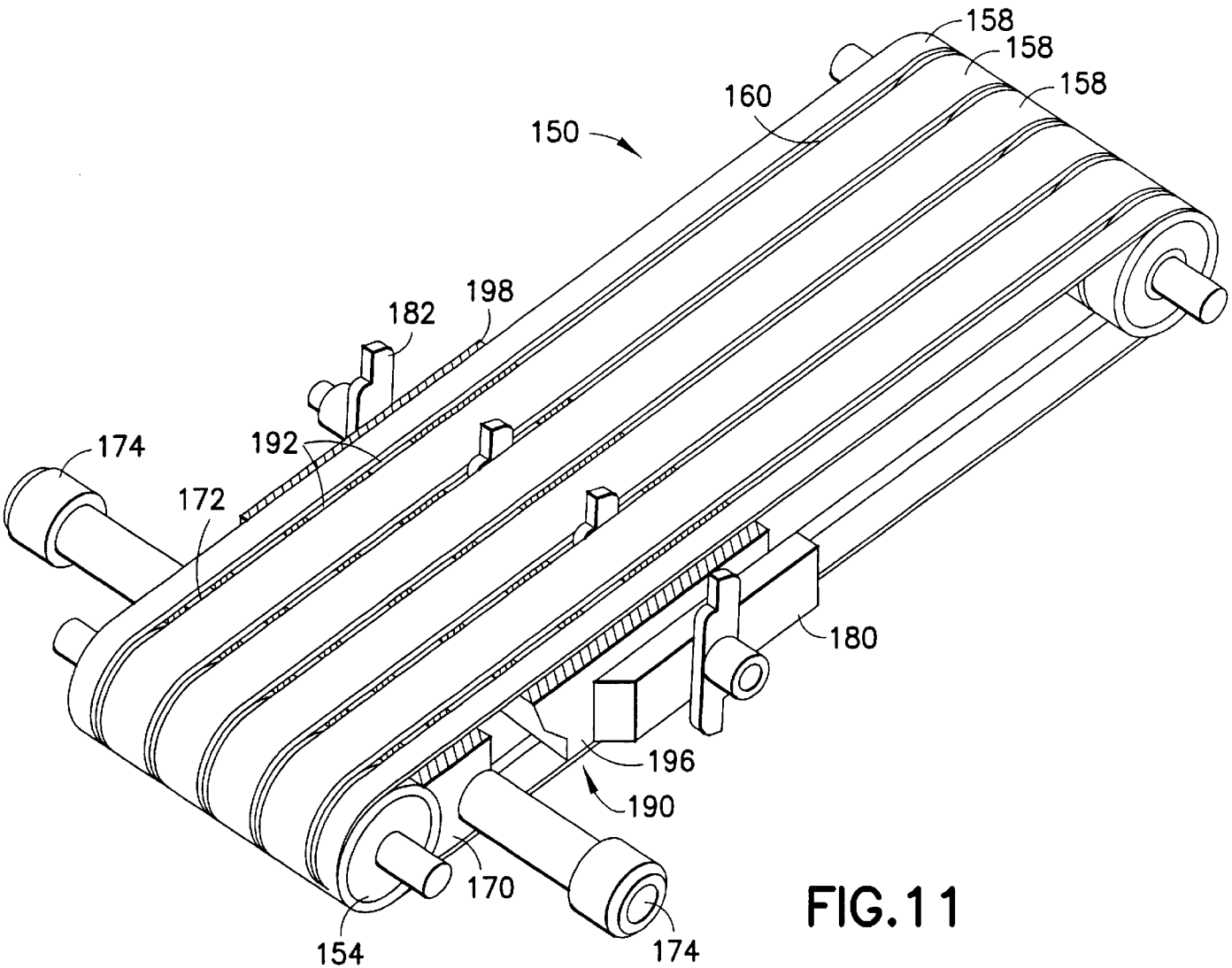
FIG. 11 is an orthogonal view showing the top of the transport module, according to the preferred embodiment of the present invention.
Figure 12:
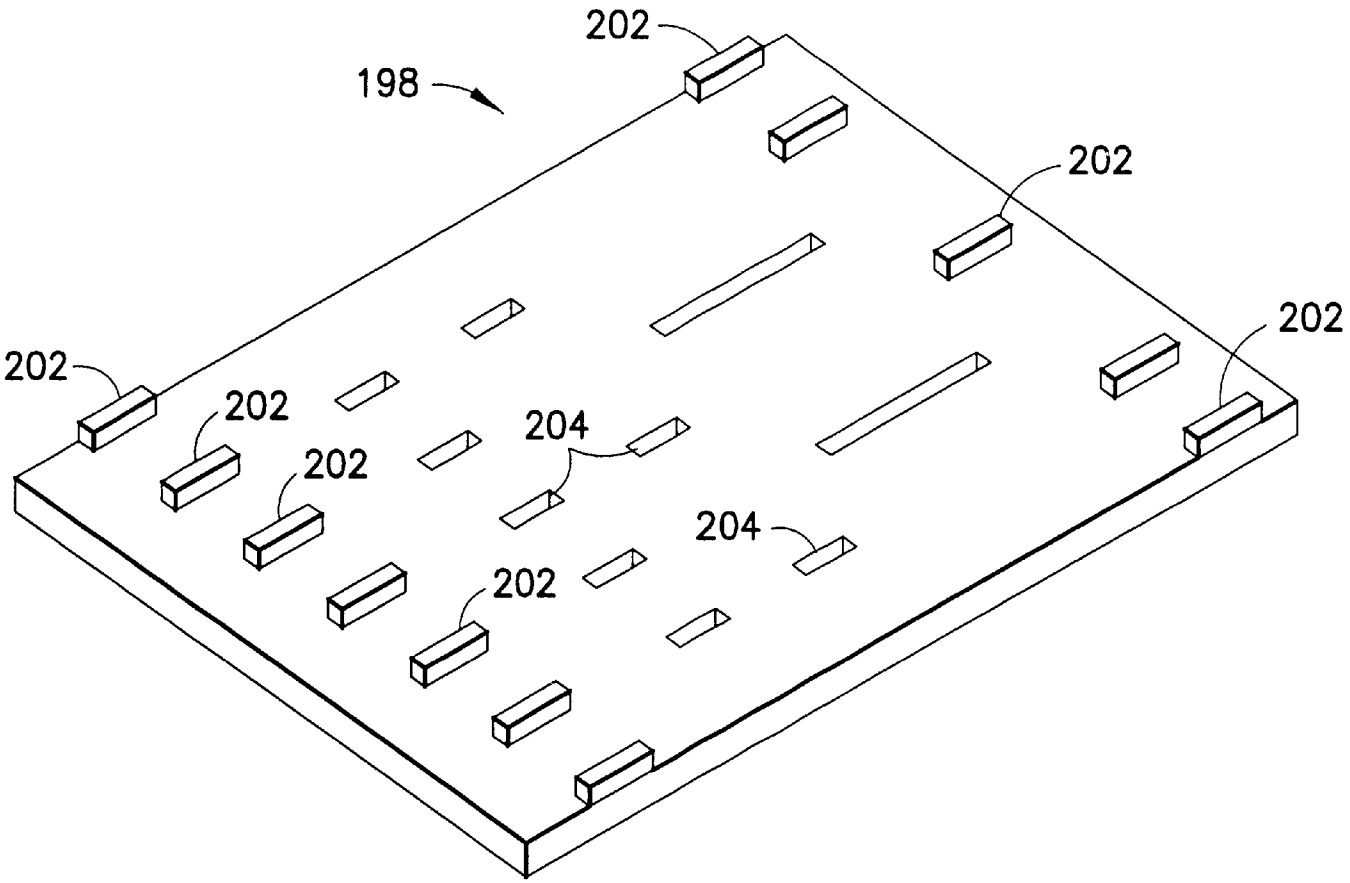
FIG. 12 is an orthogonal view showing the lid of the vacuum module, according to the present invention.

In the preferred embodiment of the present invention, as shown in FIGS. 10 to 12, the fixed vacuum module 170 covers only a small surface, $S_T$, of the envelope near the trailing edge thereof. In comparison, the movable vacuum module 190 can cover a much larger surface, $S_L$, of the envelope near the leading edge thereof. Furthermore, the vacuum module 190 has a lid 198 removably disposed on a base 196. As shown in FIG. 10, the registration mechanism 180 is fixedly attached to the base 196 of the vacuum module 190. As shown in FIG. 12, the lid 198 has a plurality of protruding guides 202 for guiding the endless belts 158 and for defining the gaps 160. The lid 198 also has a plurality of apertures 204 disposed between the protruding guides 202. When the lid 198 is securely assembled on the base 196, the apertures 204 serve as the vacuum ports 192. As such, should the number or the size of vacuum ports 192 be changed to suit the characteristics of the envelope, the lid 198 can be removed and replaced by another lid.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. An envelope transport module to be used in an envelope insertion station of a mail inserting machine, wherein an envelope has a leading edge and a trailing edge defining a dimension of the envelope, the trailing edge having a flap which is opened for enclosure material insertion when the envelope is securely held at an insertion location in the envelope insertion station, said transport module comprising:

a frame having an upstream end and a downstream end;

a transport mechanism disposed on the frame for moving the envelope into the envelope insertion station from the upstream end to the insertion location, the transport mechanism having a support surface to support the envelope;

a registration mechanism to register the leading edge of the envelope as the envelope reaches the insertion location, wherein the registration mechanism is adjustably mounted on the frame so as to allow the registration mechanism to be positioned at a location between the upstream end and the downstream end in order to accommodate the dimension of the envelope; and a vacuum suction device positioned relative to the frame between the upstream end and the downstream end so as to urge the envelope to press against the support surface, wherein the vacuum suction device comprises a first vacuum module and a separate second vacuum module, and wherein the first vacuum module is disposed between the upstream end and the registration mechanism near the upstream end to provide a suction force on the envelope near the trailing edge thereof, and the second vacuum module is adjustably disposed between the first vacuum module and the registration mechanism so that the second vacuum module can be repositioned to provide a further suction force on the envelope near the leading edge thereof.

2. The envelope transport module of claim 1, wherein the second vacuum module is mechanically linked to the registration mechanism so as to allow the second vacuum module to be relocated along with the registration mechanism, based on the dimension of the envelope.

3. The envelope transport module of claim 1, wherein the transport mechanism comprises a plurality of conveyor belts moving from the upstream end to the downstream end, and at least two adjacent ones of said conveyor belts have a gap extending from the upstream end to the downstream end, and wherein the second vacuum module has at least one vacuum port located in the gap for providing the further suction force.

4. The envelope transport module of claim 1, wherein the transport mechanism comprises a plurality of conveyor belts moving from the upstream end to the downstream end, and any two adjacent ones of said conveyor belts have a gap extending from the upstream end to the downstream end, and wherein the second vacuum module has at least one vacuum port located in the gap for providing the further suction force.

5. The envelope transport module of claim 1, wherein the registration mechanism comprises a rotatable stop operable in a first position protruding over the support surface to register the leading edge of the envelope as the envelope is located at the insertion location, and in a second position to retreat under the support surface so as to allow the envelope to move downstream after the insertion is completed.

6. A method of securing an envelope on an envelope transport module in an envelope insertion station of a mail inserting machine, wherein the envelope has a leading edge and a trailing edge defining a dimension of the envelope, the trailing edge having a flap which is opened for enclosure material insertion when the envelope is securely held at an insertion location in the envelope insertion station, and wherein the transport module comprises:

a frame having an upstream end and a downstream end;

a transport mechanism disposed on the frame for moving the envelope into the envelope insertion station from the upstream end to the insertion location, the transport mechanism having a support surface to support the envelope;

a registration mechanism to register the leading edge of the envelope as the envelope reaches the insertion location; wherein the registration mechanism is adjustably mounted on the frame so as to allow the registration mechanism to be located to a location between the upstream and downstream ends in order to accommodate the dimension of the envelope; and a vacuum suction device positioned relative to the frame between the upstream end and the downstream end so as to urge the envelope to press against the support surface, said method comprising the steps of:

providing at least one first vacuum port in the vacuum suction device in order to apply a suction force on the envelope near the trailing edge thereof, and providing at least one second vacuum port in the vacuum suction device between said at least one first vacuum port and the registration mechanism, wherein said at least one second vacuum port can be repositioned in order to apply a further suction force on the envelope near the leading edge thereof.

7. The method of claim 6, further comprising the step of providing a mechanical linkage between said at least one second vacuum port and the registration mechanism so as to allow said at least one second vacuum port to be repositioned along with the registration mechanism based on the dimension of the envelope.

* * * * *